US005528906A

United States Patent [19]

Naumovitz et al.

[11] Patent Number: 5,528,906

[45] Date of Patent: Jun. 25, 1996

[54] METHOD AND APPARATUS FOR PRODUCING ULTRA-HIGH PURITY OXYGEN

[75] Inventors: Joseph P. Naumovitz, Lebanon; Robert A. Mostello, Somerville, both of N.J.

[73] Assignee: The BOC Group, Inc., New Providence, N.J.

[21] Appl. No.: 494,899

[22] Filed: Jun. 26, 1995

[51] Int. Cl.[6] ..... F25J 3/00

[52] U.S. Cl. ..... 62/652; 62/924

[58] Field of Search ..... 62/22, 24, 39

[56] References Cited

U.S. PATENT DOCUMENTS

| | | | |
|---|---|---|---|
| 4,560,397 | 12/1985 | Cheung | 62/28 |
| 4,615,716 | 10/1986 | Cormier et al. | 62/24 |
| 4,668,260 | 5/1987 | Yoshino | 62/11 |
| 4,783,210 | 11/1988 | Ayres et al. | 62/24 |
| 4,824,453 | 4/1989 | Rottmann | 62/22 |
| 4,869,741 | 9/1989 | McGuinness et al. | 62/24 |
| 4,977,746 | 12/1990 | Grenier et al. | 62/22 |
| 5,049,173 | 9/1991 | Cormier, Sr. et al. | 62/24 |
| 5,133,790 | 7/1992 | Bianchi et al. | 62/22 |
| 5,195,324 | 3/1993 | Cheung | 62/24 |
| 5,218,825 | 1/1993 | Agrawal | 62/11 |
| 5,228,296 | 7/1993 | Howard | 62/24 |
| 5,235,816 | 8/1993 | Parsnick et al. | 62/38 |
| 5,363,656 | 11/1994 | Nagamura et al. | 62/25 |

*Primary Examiner*—Ronald C. Capossela

*Attorney, Agent, or Firm*—David M. Rosenblum; Larry R. Cassett

[57] ABSTRACT

A method and apparatus for producing a ultra-high purity oxygen product in which a nitrogen generator is operated to produce nitrogen and an oxygen rich fraction as column bottoms. Part of the oxygen rich fraction can be further processed at column pressure within rectification column to produce a tower overhead lean in hydrocarbons such as methane, acetylene, propane and propylene. After liquefaction in a head condenser of the rectification column, part of the condensate is further processed in a stripping column to produce an ultra-high purity liquid oxygen column bottoms which can be extracted as product.

8 Claims, 1 Drawing Sheet

METHOD AND APPARATUS FOR PRODUCING ULTRA-HIGH PURITY OXYGEN

BACKGROUND OF THE INVENTION

The present invention relates to a method and apparatus for producing ultra-high purity oxygen from the separation of air. More particularly, the present invention relates to such a process and apparatus in which the air is first separated into nitrogen and oxygen rich fractions and then is further refined to separate hydrocarbons, argon and nitrogen from the oxygen rich fraction to produce the ultra-high purity oxygen. Even more particularly the present invention relates to such a method and apparatus in which the hydrocarbons are first removed from the oxygen rich fraction by rectification and then argon and nitrogen are separated by stripping the oxygen rich fraction.

Air is separated into nitrogen and oxygen rich fractions by various cryogenic rectification processes. In accordance with one such process, incoming air, after having been compressed and cooled to a temperature suitable for its rectification, is rectified in a higher pressure column into oxygen and nitrogen rich fractions. The oxygen rich fraction is further refined in a lower pressure column connected to the higher pressure column in a heat transfer relationship. As a result of such refinement, a gaseous nitrogen tower overhead and a liquid oxygen column bottoms collect in the lower pressure column. The higher boiling components such as hydrocarbons tend to concentrate in the liquid oxygen. Argon, which has a similar volatility to oxygen, will also form part of the liquid oxygen column bottoms. Thus, the liquid oxygen produced in the lower pressure column typically is not of ultra-high purity.

In another type of cryogenic rectification process, air is separated in a single column known in the art as a nitrogen generator. In the nitrogen generator, an oxygen rich fraction is produced as column bottoms and a high-purity nitrogen rich fraction is produced as tower overhead. The oxygen rich fraction, known as crude liquid oxygen, can be used as a coolant for the head condenser at the top of the nitrogen generator in order to provide reflux for the column. After having been used to so provide reflux, the oxygen rich fraction is discharged as waste and part of it may be recompressed either at column temperature or at ambient temperature and then recycled back to the column. This type of column, although capable of producing high-purity nitrogen, is therefore not in of itself capable of producing ultra-high purity liquid oxygen.

There are plant applications that require an ultra-high purity oxygen product. For instance, in U.S. Pat. No. 4,977,746, first and second auxiliary columns are used in conjunction with a double column arrangement to produce ultra-high purity oxygen. In this patent, gas from above the liquid oxygen sump of the lower pressure column is rectified within the first auxiliary column to produce a gaseous tower overhead free of hydrocarbons. The gaseous tower overhead is then distilled in the second auxiliary column to produce ultra-pure liquid oxygen as a column bottoms. U.S. Pat. No. 5,363,656 discloses a nitrogen generator in which crude liquid oxygen is rectified in a second rectification column to separate nitrogen gas from the crude liquid. The resultant liquid oxygen is heated so as to be evaporated by a reboiler of the second rectification column and the evaporated oxygen is then introduced into a third rectification column to produce high purity oxygen gas. The high-purity oxygen gas in then introduced into a fourth rectification column so that oxygen, nitrogen, carbon monoxide and argon, are produced as tower overhead and an ultra-high purity liquid oxygen is produced as column bottoms.

A major problem in the prior an is that a large capital expenditure is required to produce the ultra-high purity liquid oxygen. For instance, in both of the above-mentioned patents, four separate distillation columns are required. As will be discussed, the present invention provides a method and apparatus for producing ultra-high purity oxygen which is particularly well adapted to be used with a nitrogen generator that is designed to efficiently produce high-purity nitrogen in addition to the ultra-high purity oxygen.

SUMMARY OF THE INVENTION

The present invention provides a method of producing ultra-high purity oxygen. The term "ultra-high purity oxygen" as used herein and in the claims means oxygen containing; less than about 100 parts per billion argon, less than about 10 parts per billion of the impurities such as methane, acetylene, propane and propylene and less than about 10 parts per billion parts nitrogen. As used herein and in the claims, the term "composed" connotates the make-up of the stream and not the amount of the make-up that was used in forming the stream.

In accordance with the method, the air is separated into oxygen and nitrogen rich fractions within a distillation column by a low temperature rectification process. The low temperature rectification process includes forming a valve expanded coolant stream composed of the oxygen rich fraction. A nitrogen rich stream composed of the nitrogen rich fraction is condensed by indirectly exchanging heat between the valve expanded coolant stream and the nitrogen rich stream. Such condensation causes complete vaporization of the coolant stream to form a vaporized coolant stream. The distillation column is then refluxed with at least part of the nitrogen rich stream. A portion of the vaporized coolant stream is compressed to column pressure of the distillation column to form a compressed crude oxygen stream. After the portion of the compressed crude oxygen stream is cooled, it is introduced into the distillation column.

A first subsidiary stream formed from part of the portion of the compressed crude oxygen stream, after the cooling thereof, is rectified in a rectification column. This produces a substantially hydrocarbon-free tower overhead within the rectification column and a liquid fraction, as column bottoms concentrated in higher boiling impurities including hydrocarbons. A second subsidiary stream is formed from a portion of a crude oxygen stream composed of the oxygen rich fraction. Additionally, a hydrocarbon-free stream is formed from the substantially hydrocarbon-free tower overhead. This second subsidiary stream indirectly exchanges heat with the hydrocarbon-free stream to thereby condense the hydrocarbon free stream. The rectification column is refluxed with part of the hydrocarbon-free stream and another part thereof is introduced into a stripping column so that argon and nitrogen are stripped therefrom to produce the ultra-high purity oxygen as column bottoms. Part of the ultra-high purity oxygen is vaporized against at least part of the second subsidiary stream to produce boil-up in the stripping column. A stream of the liquid fraction of the rectification column is combined with the at least part of the second subsidiary stream to produce a combined stream. The combined stream is combined with a remaining portion of the crude oxygen stream, thereby to form the coolant stream.

The ultra-high purity oxygen stream is extracted from the stripping column as product.

In another aspect the present invention provides an apparatus for producing an ultra-high purity oxygen. In accordance with this aspect of the present invention an air separation plant is provided that includes a main heat exchange means for cooling compressed and purified air to a temperature suitable for its rectification and a distillation column connected to the main heat exchange means for separating the compressed and purified air into oxygen and nitrogen rich fractions. A first head condenser is connected to the distillation column so that a nitrogen rich stream composed of the nitrogen rich fraction is condensed through indirect heat exchange with a coolant stream composed of the oxygen rich fraction. The distillation column is refluxed with at least part of the nitrogen rich stream. A recycle compressor is connected between the main heat exchange means the first head condenser so that at least part of the coolant stream is compressed to column pressure of the distillation column and thereby forms a compressed crude oxygen stream which is in turn cooled to the temperature of the distillation column.

A rectification column is provided which together with the distillation column is connected to the main heat exchange means so that the part of the compressed crude oxygen stream returns to the distillation column and a first subsidiary stream, formed from a remaining part of the compressed crude oxygen stream, is introduced into the rectification column. The rectification column is configured to rectify the oxygen rich fraction contained within the first subsidiary stream, thereby to produce a substantially hydrocarbon-free tower overhead and a liquid fraction, as column bottoms, concentrated in the higher boiling impurities including hydrocarbons. A second head condenser is connected to the rectification column for receiving a second subsidiary stream formed from a portion of a crude oxygen stream composed of the oxygen rich fraction. The second head condense functions to indirectly exchange heat between the second subsidiary stream and the hydrocarbon-free stream, composed of the hydrocarbon-free tower overhead. This condenses the hydrocarbon-free stream. A part of the hydrocarbon-free stream is returned to the rectification column as reflux.

A stripping column is connected to the second head condenser to receive another part of the hydrocarbon-free stream, after the condensation thereof. The stripping column is configured to strip argon and nitrogen from the another part of the hydrocarbon-free stream to produce the ultra-high purity oxygen as column bottoms. An expansion valve is interposed between said stripping column and said second head condenser to facilitate the stripping of argon and nitrogen from said another hydrocarbon-free stream. A heat exchanger is connected between the second head condenser and the stripping column for vaporizing part of the ultra-high purity oxygen against at least part of the second subsidiary stream after having condensed the hydrocarbon-free stream to produce boil-up in the stripping column. The rectification column and the heat exchanger are connected to combine a stream of the liquid fraction of the rectification column with the at least part of the second subsidiary stream, thereby to produce a combined stream. A means is provided for combining a remaining portion of the crude oxygen stream with the combined stream, thereby to form the coolant stream. The means also expand the coolant stream to a sufficiently low temperature required for the condensation of the nitrogen rich stream. A means is provided for extracting an ultra-high purity oxygen stream from the stripping column as product.

The present invention, as contrasted with prior art techniques utilizes three (instead of four) columns to produce an ultra-high purity oxygen product at pressure. Unlike the prior art, a compressed crude oxygen stream is rectified to rid the eventual product of hydrocarbons. Thereafter, a stripping column, acting at low pressure, separates argon and nitrogen from the product to produce the ultra-high purity oxygen product. Another feature of the present invention is that crude liquid oxygen serves both to condense tower overhead in the rectification column and to vaporize ultra-high purity oxygen in the stripping column. This arrangement simplifies piping layouts in a plant constructed in accordance with the present invention. A still further advantage of the present invention is that it can be integrated with a nitrogen generator employing recompression of the crude liquid oxygen stream, after having served as coolant in the head condenser, for recycle back into the nitrogen generating column. An example of such a nitrogen generating scheme can be found in U.S. Pat. No. 4,966,002.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which the sole Figure is a schematic of an air separation plant operating in accordance with a method of the present invention.

DETAILED DESCRIPTION OF THE DRAWINGS

Figure 1:
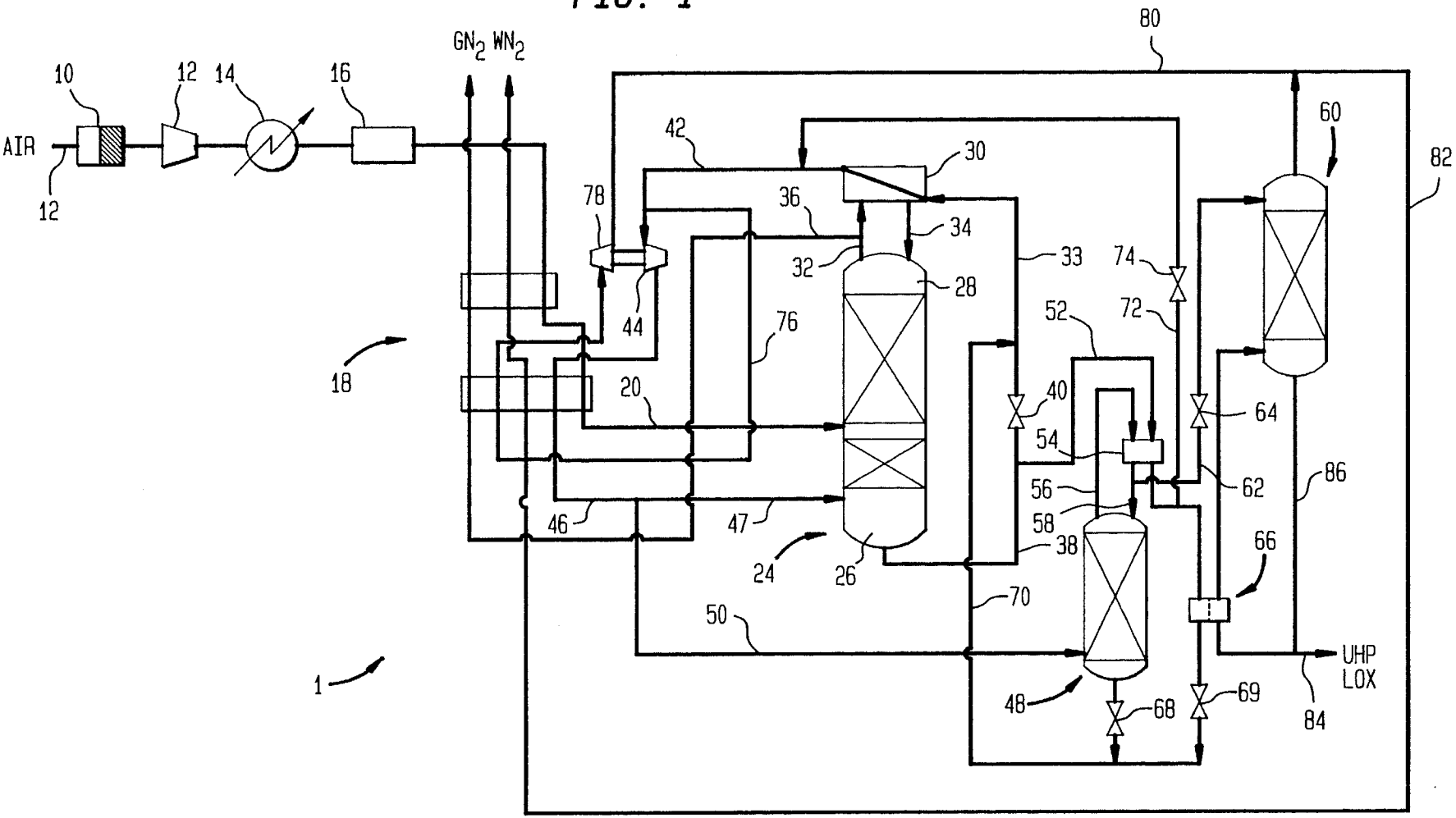

With reference to the Figure, an air separation plant 1 is illustrated that is designed to produce a high purity gaseous nitrogen product and an ultra-high purity liquid oxygen product. It should be pointed out that the present invention has equal applicability to a nitrogen generator that is designed to produce nitrogen at lower purity than the air separation plant 1. As illustrated, air is filtered in the filter 10 and is then compressed in a compressor 12. The heat of compression is removed by an aftercooler 14 and the air is then initially processed in a pre-purification unit 16 to remove carbon dioxide and water vapor. The air is then cooled within a main heat exchanger 18 to a temperature suitable for its rectification, which in the illustrated embodiment partially liquefies the air into an air stream 20. Distillation column 24 separates the air into an oxygen-rich fraction which collects in a sump or bottom region 26 of distillation column 24 and a high-purity nitrogen rich fraction which collects in a top region 28 of distillation column 24 as tower overhead.

A first head condenser 30 is connected to distillation column 24 so that a nitrogen rich stream 32 composed of the nitrogen rich fraction is condensed through indirect heat exchange with a coolant stream 33 composed of the oxygen rich fraction that has collected in sump 26 of distillation column 24. This forms a condensed nitrogen rich stream 34 which is introduced into top region 28 of distillation column 24 as reflux. Part of nitrogen rich stream 32 can be extracted as a gaseous nitrogen product stream 36 which is fully warmed in main heat exchanger 18. In a proper case, a liquid nitrogen product stream could also be formed from part of the condensed nitrogen rich stream 34. In this regard, "high purity nitrogen" as used herein and in the claims means nitrogen having a purity of less than about 100 parts per billion oxygen by volume.

Coolant stream 33 is partly formed from a crude oxygen stream 38 extracted from bottom region 26 of distillation column 24. An expansion valve 40 is provided for valve expanding part of the crude oxygen stream 38 (producing coolant stream 33) to a sufficiently low temperature to condense nitrogen rich stream 32 within first head condenser 30. A vaporized coolant stream 42 is formed which is vaporized crude liquid oxygen. A portion of vaporized coolant stream 42 is recompressed within a recycle compressor 44 to the column pressure of distillation column 24. This compressed coolant forms a compressed crude oxygen stream 46. The recycle compressor is connected between main heat exchanger 18 and first head condenser 30 so that the compressed crude oxygen stream 46 is cooled to a rectification temperature at which distillation column 24 operates. Distillation column 24 is connected to main heat exchanger 18 so that a part 47 of compressed crude oxygen stream 46 is introduced into bottom region 26 of distillation column 24.

A rectification column 48 is also connected to main heat exchanger 18 to receive a first subsidiary stream 50 formed from a remaining part of compressed crude oxygen stream 46 after cooling within main heat exchanger 18. Rectification column 48 is configured to rectify crude oxygen contained within first subsidiary stream 50 in order to produce a substantially hydrocarbon-free tower overhead and a liquid fraction as column bottoms. The column bottoms is concentrated in the hydrocarbons. Typically fast subsidiary stream 50 contains about 45% by volume of oxygen with the remainder being made up of nitrogen and argon and higher boiling impurities such as methane, krypton, and xenon. These higher boiling impurities have a concentration of approximately 10 parts per million within fast subsidiary stream 50. After rectification, the tower overhead has a concentration of approximately 30% by volume of oxygen and less than 0.1 parts per billion methane, about 1½% argon and the remainder nitrogen.

A second subsidiary stream 52 is formed which is composed of a portion of crude oxygen stream 38. A second head condenser 54 is connected to rectification column 48 for receiving second subsidiary stream 52 and indirectly exchanging heat between second subsidiary stream 52 and a hydrocarbon-free stream 56, composed of the substantially hydrocarbon-free tower overhead. Second head condenser 54 acts to condense hydrocarbon-free stream 56 and return a part of the hydrocarbon-free stream 56 as a reflux stream 58 back to rectification column 48.

A stripping column 60 is connected to second head condenser 54 to receive another part 62 of hydrocarbon-free stream 56, after the condensation thereof within second head condenser 54. Stripping column 60 is configured to strip argon and nitrogen from the another part of hydrocarbon-free stream 56 to produce the ultra-high purity oxygen as column bottoms. An expansion valve 64 is interposed between stripping column 60 and second head condenser 54 to valve expand the "another part 62+ of the hydrocarbon-free stream to a low pressure. This low pressure causes stripping column 60 to operate at a sufficiently low pressure to facilitate separation of argon and nitrogen, together, from oxygen to produce the ultra-high purity liquid oxygen. A heat exchanger or a reboiler 66 is connected to second head condenser 54 and stripping column 60 for vaporizing part of the ultra-high purity oxygen with part of second subsidiary stream 52, after the second subsidiary stream has acted to condense hydrocarbon-free stream 56. This causes vaporization of the ultra-high purity liquid oxygen to produce boil-up within stripping column 60 and condensation of the part of second subsidiary stream 52.

A stream of the liquid fraction of rectification column 48 and the part of the second subsidiary stream 52 are valve expanded in expansion valves 68 and 69, respectively, and are combined to form a combined stream 70. Combined stream 70 having the pressure of crude oxygen stream 38 after its expansion through valve 40 is combined with a remaining portion of crude oxygen stream 38 that remains after formation of second subsidiary stream 52. This combination produces coolant stream 33.

Not all of second subsidiary stream 52 is required to boil ultra-high purity liquid oxygen within stripping column 60. Thus, a bypass stream 72 can be extracted from second subsidiary stream 52 downstream of second head condenser 54 and combined with coolant stream 33 (after vaporization thereof) to form vaporized coolant stream 42. Pressure reduction is accomplished by means of an expansion valve 74. This is, however, optional and as such, all of second subsidiary stream 52 could be used to boil ultra-high purity liquid oxygen within stripping column 60.

In order to supply refrigeration to air separation plant 1 and thereby balance heat leakage and warm end heat exchanger losses, a third subsidiary stream 76 is formed from a further portion of vaporized coolant stream 42. Third subsidiary stream 76 is preferably partially warmed, that is warmed between the cold and warm end temperatures of main heat exchanger 18, and is then expanded in a turboexpander 78 to produce the refrigeration. As illustrated, turboexpander 78 is coupled to recycle compressor 44 to use at least part of the work performed by the turboexpansion for the recycle compressor 44. The tower overhead produced within stripping column 60 which contains in the main, argon and nitrogen can be combined with a resultant turboexpanded stream 80 to produce a waste nitrogen stream 82 which is fully warmed within main heat exchanger 18 to the temperature of the warm end of main heat exchanger 18.

The resultant ultra-high purity liquid oxygen produced within stripping column 60 contains oxygen, less than about 3 parts per billion by volume of hydrocarbons such as methane, acetylene, propane and propylene, less than about 50 parts per billion by volume of argon and less than about 1 part per billion by volume of nitrogen. The ultra-high purity stream can be extracted as a product stream 84 from part of a recirculating boil-up stream 86 passing through heal exchanger 66 to provide boil-up for stripping column 60. As can be appreciated, if high-purity oxygen were required as a gaseous product, all or part of product stream could be vaporized either through a separate vaporizer or withdrawn as a vapor from stripping column 60 and passed through main heat exchanger 18.

While the present invention has been discussed by reference to a preferred embodiment, as will be understood by those skilled in the art, numerous changes, additions, and omissions can be made without departing from the spirit and scope of the present invention.

We claim:

1. A method of producing ultra-high purity oxygen comprising:

separating air into oxygen and nitrogen rich fractions within a distillation column by a low temperature rectification process;

said low temperature rectification process including:

forming a valve expanded coolant stream composed of said oxygen rich fraction;

condensing a nitrogen rich stream composed of said nitrogen rich fraction by indirectly exchanging heat between said valve expanded coolant stream and said nitrogen rich stream, thereby forming a vaporized coolant stream, and refluxing said distillation column with at least part of said nitrogen rich stream;

compressing at least pan of said vaporized coolant stream to column pressure of said distillation column to form a compressed crude oxygen stream; and cooling said compressed crude oxygen stream and introducing said part of said compressed crude oxygen stream into said distillation column;

forming a first subsidiary stream from a remaining part of said compressed crude oxygen stream after the cooling thereof;

rectifying said first subsidiary stream in a rectification column to produce a substantially hydrocarbon-free tower overhead within said rectification column and a liquid fraction, as column bottoms, concentrated in higher boiling impurities including hydrocarbons;

forming a second subsidiary stream from a portion of a crude oxygen stream composed of said oxygen enriched fraction:

forming a hydrocarbon-free stream from said substantially hydrocarbon-free tower overhead;

indirectly exchanging heat between said second subsidiary stream and said hydrocarbon-free stream, thereby to condense said hydrocarbon-free stream;

refluxing said rectification column with part of said hydrocarbon-free stream and introducing another part thereof into a stripping column so that argon and nitrogen are stripped therefrom to produce said ultra-high purity oxygen as column bottoms;

vaporizing part of said ultra-high purity oxygen with at least part of said second subsidiary stream to produce boil-up in said stripping column, combining a stream of said liquid fraction of said rectification column with the at least part of the second subsidiary stream to produce a combined stream, and combining said combined stream with a remaining portion of said crude oxygen stream, thereby to form said coolant stream; and extracting an ultra-high purity oxygen stream from said stripping column as product.

2. The method of claim 1, wherein said part of said vaporized coolant stream is compressed at a temperature of said distillation column.

3. The method of claim 1 or claim 2, further comprising:

forming a third subsidiary stream from a further part of said vaporized coolant stream;

expanding said third subsidiary stream with the performance of work to refrigerate said low temperature rectification process; and utilizing at least part of the work of expansion in the compression of said vaporized coolant stream.

4. The method of claim 3, wherein:

said air is compressed, purified and cooled to a temperature suitable for its rectification;

part of said nitrogen rich stream after having been condensed is formed into a product stream;

a waste stream is formed from tower overhead produced in said stripping column; and said air and said at least part of said compressed crude oxygen stream cool through indirect heat exchange with said product, waste and third subsidiary streams.

5. The method of claim 4, wherein said air is separated so that said nitrogen rich fraction is of high purity.

6. An apparatus for producing an ultra-high purity oxygen product comprising:

an air separation plant including:

main heat exchange means for cooling compressed and purified air to a temperature suitable for its rectification;

a distillation column connected to said main heat exchange means for separating said compressed and purified air into oxygen and nitrogen rich fractions;

a first head condenser connected to said distillation column so that a nitrogen rich stream composed of said nitrogen rich fraction is condensed through indirect heat exchange with a coolant stream composed of said oxygen rich fraction, thereby to form a vaporized coolant stream, and said distillation column is refluxed with at least part of said nitrogen rich stream; and a recycle compressor connected between said main heat exchange means and said first head condense so that at least part of said vaporized coolant stream is compressed to column pressure of said distillation column and thereby forms a compressed crude oxygen stream which is in turn cooled to said temperature;

a rectification column;

said distillation column and said rectification column connected to said main heat exchange means so that said part of said compressed crude oxygen stream returns to said distillation column and a first subsidiary stream formed from a remaining part of said crude oxygen stream is introduced into said rectification column;

said rectification column configured to rectify said oxygen rich fraction contained within said first subsidiary stream, thereby to produce a substantially hydrocarbon-free tower overhead and a liquid fraction, as column bottoms, concentrated in higher boiling impurities including hydrocarbons;

a second head condenser connected to said rectification column for receiving a second subsidiary stream formed from a portion of a crude oxygen stream composed of said oxygen rich fraction and for indirectly exchanging heat between said second subsidiary stream and a hydrocarbon-free stream, composed of said hydrocarbon-free tower overhead, thereby to condense said hydrocarbon-free stream and to return a part of said hydrocarbon-free stream to said rectification column as reflux;

a stripping column connected to said second head condenser to receive another part of said hydrocarbon-free stream, after the condensation thereof;

said stripping column configured to strip argon and nitrogen from said another hydrocarbon-free stream to produce said ultra-high purity oxygen as column bottoms;

an expansion valve interposed between said stripping column and said second head condenser to facilitate the stripping of argon and nitrogen from said another hydrocarbon-free stream;

a heat exchanger connected to said second head condenser and said stripping column for vaporizing part of said ultra-high purity oxygen with at least part of said second subsidiary stream, after having condensed said hydrocarbon-free stream, to produce boil-up in said stripping column;

said rectification column and said heat exchanger connected to combine a stream of said liquid fraction of said rectification column with said at least part of said second subsidiary stream, thereby to produce a combined stream;

means for combining a remaining portion of said crude oxygen stream with said combined stream, thereby to form said coolant stream and for expanding said coolant stream to a sufficiently low temperature required for condensing said nitrogen rich stream; and means for extracting an ultra-high purity oxygen stream from said stripping column as product.

7. The apparatus of claim 6, wherein said recycle compressor is connected to said main heat exchanger so that said part of said vaporized coolant stream is compressed at a temperature of said distillation column.

8. The apparatus of claim 6 or claim 7, further comprising:

engine expansion means for expanding a partially warmed third subsidiary stream formed from a further part of said vaporized coolant stream with the performance of work to refrigerate said low temperature rectification process; and said engine expansion means coupled to said recycle compressor so that at least part of the work of expansion is utilized in the compression of said crude oxygen stream.

* * * * *